United States Patent [19]

Coombs et al.

[11] Patent Number: 4,953,865

[45] Date of Patent: Sep. 4, 1990

[54] PUTTING PRACTICE DEVICE

[75] Inventors: Donald W. Coombs, Tucson, Ariz.; Andrew A. Anderson, Antioch, Ill.

[73] Assignee: Matthew C. Dunne, Tucson, Ariz.

[21] Appl. No.: 413,251

[22] Filed: Sep. 27, 1989

[51] Int. Cl.[5] ..... A63B 69/36

[52] U.S. Cl. ..... 273/176F; 273/176 H; 273/185 R; 273/176 J; 273/192

[58] Field of Search ..... 273/176 B, 176 E, 176 F, 273/176 FA, 176 FB, 176 G, 176 H, 176 J, 176 K, 177 R, 177 A, 177 B, 32 R, 35 R, 184 A, 185 R, 191 R, 191 A, 191 B, 192, 186 R, 186 C

[56] References Cited

U.S. PATENT DOCUMENTS

| | | | |
|---|---|---|---|
| 1,063,119 | 5/1913 | Clifford | 273/176 B |
| 1,582,237 | 4/1926 | Angell | 273/176 F |
| 1,676,804 | 7/1928 | Scheck | 273/176 F |
| 1,961,060 | 5/1934 | McCarthy | 273/177 A |
| 2,465,418 | 3/1949 | Baker | 273/176 H |
| 2,467,549 | 4/1949 | Ely et al. | 273/177 A |
| 2,827,299 | 3/1958 | Dean | 273/176 |
| 2,869,875 | 1/1959 | Steenson | 273/177 R |
| 3,009,704 | 11/1961 | Heard | 273/179 |
| 3,101,949 | 8/1963 | Williams | 273/186 |
| 3,332,688 | 7/1967 | Gevertz | 273/186 |
| 3,464,699 | 9/1969 | Dollar | 273/177 R |
| 3,464,704 | 9/1969 | Nelson | 273/176 |
| 3,508,756 | 4/1970 | Bedford | 273/176 H |
| 3,831,949 | 8/1974 | Henning | 273/176 |
| 3,856,313 | 12/1974 | Tierney | 273/176 |
| 4,344,624 | 8/1982 | Laursen | 273/176 |
| 4,620,708 | 11/1986 | Meyer et al. | 273/192 |
| 4,805,912 | 2/1989 | Hickman | 273/176 |
| 4,826,174 | 5/1989 | Hoyt, Jr. | 273/186 |

FOREIGN PATENT DOCUMENTS

| | | | |
|---|---|---|---|
| 2448368 | 4/1976 | Fed. Rep. of Germany | 273/411 |
| 704313 | of 1931 | France | 273/176 |
| 6806114 | 10/1968 | Netherlands | 273/176 |

*Primary Examiner*—George J. Marlo

*Attorney, Agent, or Firm*—Cahill, Sutton & Thomas

[57] ABSTRACT

A putt practice device includes an elongated, thin, planar base having a carpeted upper surface, a putting end, and a target end. A pair of spaced rows of pegs extend upwardly from the planar base. Caps consisting of cut off golf tees having holes drilled into their lower ends are placed on the two rows of pegs, defining a putting path along which a sufficiently accurately putted golf ball can roll without touching any of the modified golf tees on either side. A removable ball stop is attached to a pair of the pegs at the target end of the putt practice device. The putt practice device also can be utilized on a putting green by removing the ball stop, and aiming the longitudinal axis of the putt practice device toward a hole on the putting green. If the surface of the putting green is sloped, the orientation of the practice putting device can be aimed to one side or the other of the target hole to compensate for slope in the putting green surface. Use of the device significantly improves development of putting skills and judgement in compensating for sloped surfaces of a putting green. The planar base is sufficiently flexible that a target end portion can be elevated while the rest of the planar base remains flat on a floor surface or the like, so the putted golf ball rolls back to the golfer.

10 Claims, 2 Drawing Sheets

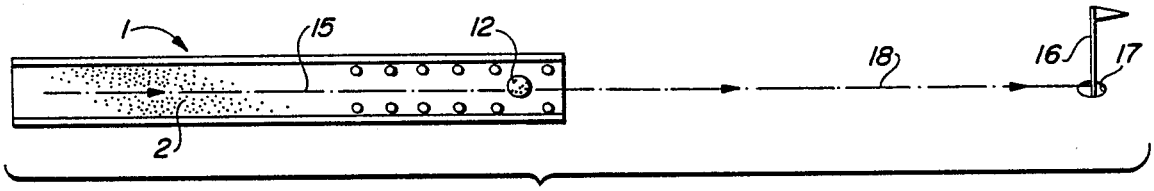
FIG. 5A
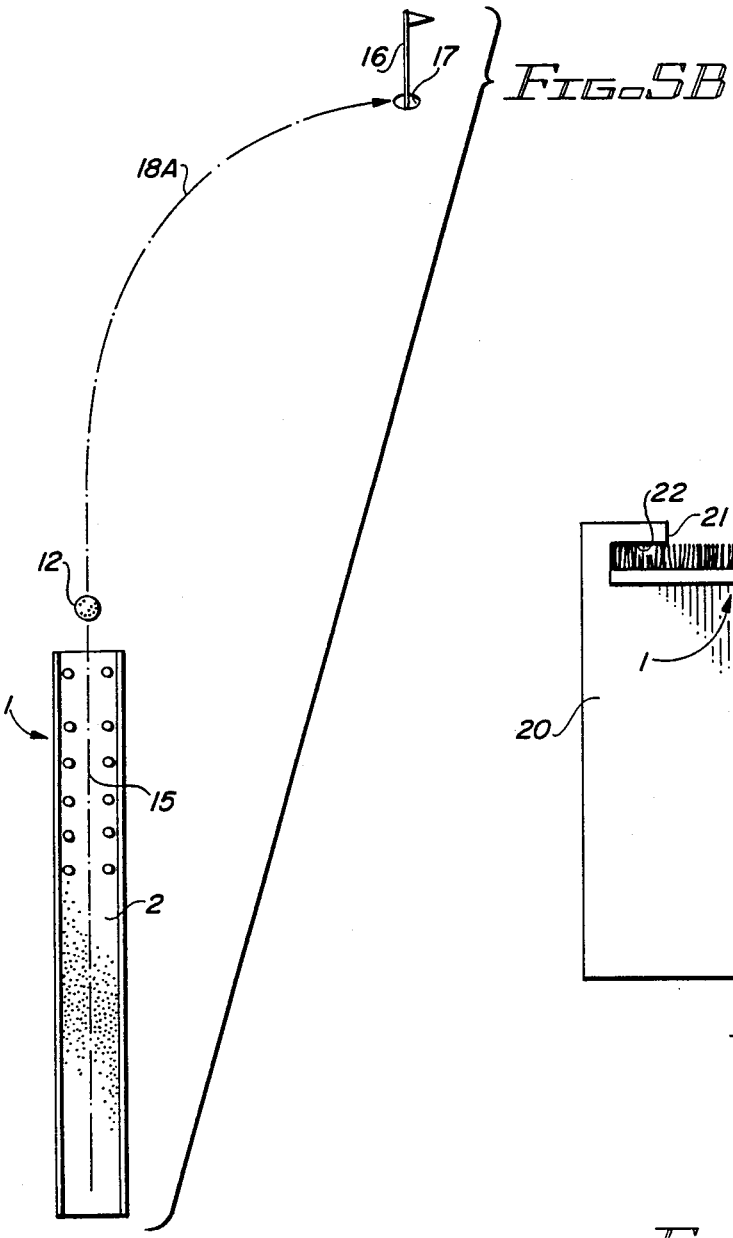
FIG. 5B
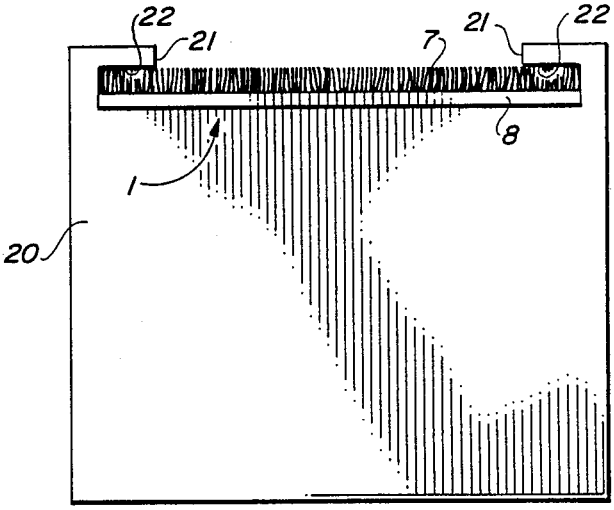
FIG. 6B
FIG. 6A
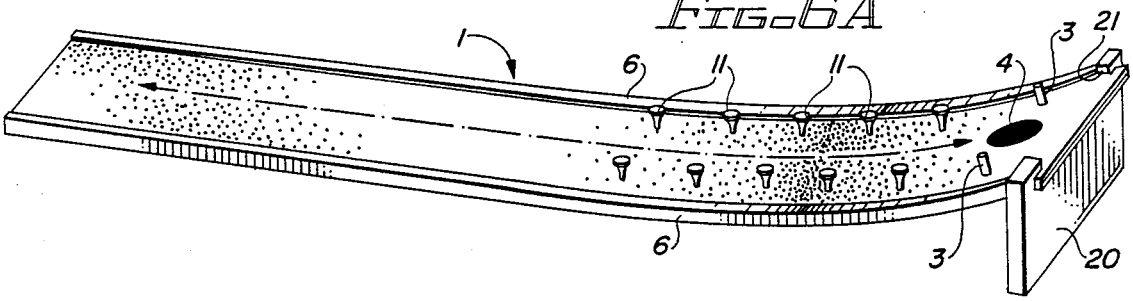

PUTTING PRACTICE DEVICE

BACKGROUND OF THE INVENTION

The invention relates to a device and method used to practice golf putting, and particularly to a device which is useful both indoors on a horizontal floor surface and outdoors on a sloped putting green.

A wide variety of golf putt practice devices and learning aids are known. Some include elongated putting surfaces having a putting path along a centerline of the putting surface. Some have upwardly inclined surfaces and receptacles for the putted golf ball to drop into. Some of the known devices provide rails or guides that contact the ball as it moves along a particular path. Some of the proposed devices include a remote "target" separate from a putting station. Still others have various pins or the like which define a path through which a golf ball, if putted with sufficient accuracy, rolls without touching any of the pins or the like. Most of the known putt practice devices are designed for indoor usage on a precisely horizontal floor surface. Most of the prior putt practice devices are not well suited to both indoor use on a perfectly flat surface and outdoor use on a putting green so as to aid the golfer in improving the accuracy of his putting despite the existence of a sloped putting green. Most of the prior devices elevate the putting position of the golf ball more than is desirable. There is a need for an improved putt training device which is more versatile than the prior art.

SUMMARY OF THE INVENTION

Accordingly, it is an object of the invention to assist a golfer in improving control of his putting.

It is another object of the invention to provide a putt practice device which is more versatile than prior putt practice devices.

It is another object of the invention to provide a putt practice device which is useful in indoor practice on a horizontal floor surface and outdoors on an ordinary putting green which may be sloped.

It is another object of the invention to provide a golf putt practice with adjustable accuracy control.

Briefly described, and in accordance with one embodiment thereof, the invention provides a golf putt practice or training device which includes a thin, elongated, flexible, planar steel base plate with a thin layer of carpet uniformly attached to its upper surface. Two rows of studs extend upwardly from the steel base plate through the carpet. A plurality of pegs or caps, which can be cut off golf tees with bottom holes to allow the pegs to be placed on the studs. The two rows of studs with caps thereon define a putting path for the golf ball, and are positioned at one end of the putt practice device. A ball stop can be positioned on a pair of the studs at a target end to act as a target if the putt practice device is used indoors. The ball stop can be removed, allowing the device to be used outdoors on a putting green, so that the ball putted from a putting end of the practice device rolls from the target end if the ball is putted with sufficient accuracy that it does not touch any of the caps defining the putting path. Different putting accuracy requirements can be established by using taller caps to increase the required putting accuracy or shorter caps to reduce the required putting accuracy. In one embodiment, a stand can be attached to the target end of the practice device, raising it. The base plate is sufficiently flexible that the putting end portion of the putt practice device remains flat on the floor surface. This embodiment of the invention is suited to indoor use, where the user putts from the putting end of the practice device. The putted ball rolls up the raised target end portion of the putt practice device, strikes the ball stop, and then rolls backward to the user.

BRIEF DESCRIPTION OF THE DRAWINGS

FIG. 5A is a diagram useful in illustrating use of the device on a horizontal putting green.

FIG. 5B is a diagram useful in describing utilization of the practice device on a putting green with a sloped surface.

FIG. 6A is a perspective view of an alternate embodiment of the invention.

FIG. 6B is a plan view of the end support of the embodiment shown in FIG. 6A.

DETAILED DESCRIPTION OF THE PREFERRED EMBODIMENTS OF THE INVENTION

Figure 1:
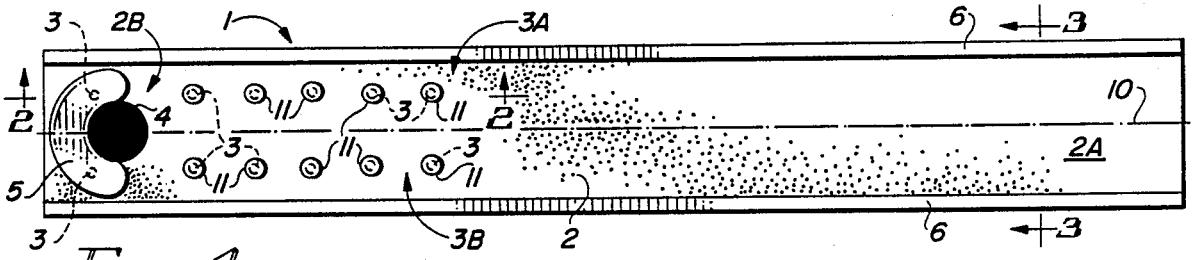
FIG. 1 is a top view of the golf practice device of the present invention.
Figure 2:
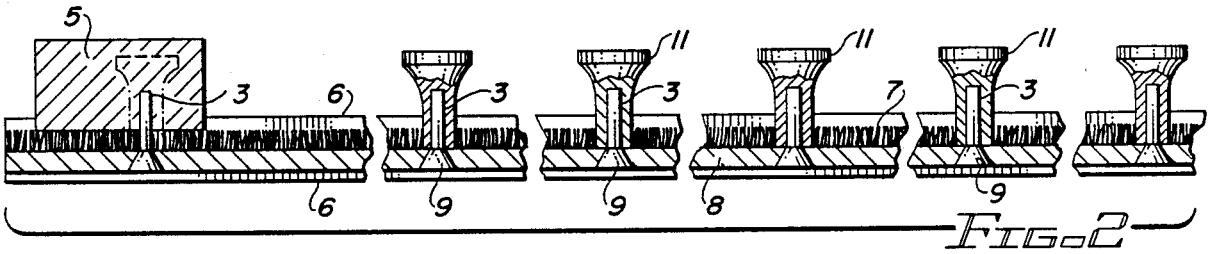
FIG. 2 is a section view along section line 2—2 of FIG. 1.
Figure 3:
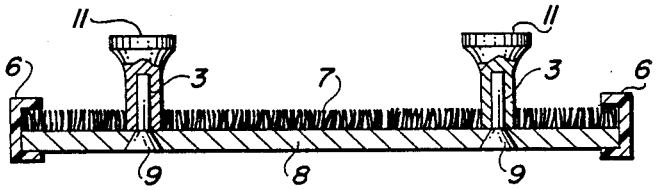
FIG. 3 is a section view along section line 3—3 of FIG. 1.

Referring now to the drawings, particularly FIGS. 1-3, golf putt practice device 1 includes an elongated, narrow, planar base 2 having a putting end 2A and a target end 2B. A first row 3A of elongated, cylindrical, unthreaded steel studs 3 which extend vertically upward from the surface of planar base 2. A second row 3B of additional studs 3 extend vertically upward from the surface of base 2. Row 3B is positioned symmetrically opposite to row 3A with respect to a longitudinal center axis 10 of planar base 2. Each of a plurality of caps 11 are placed over a respective stud 3, thereby defining a putting path generally along dotted line axis 10, along which a golf ball rolls if putted sufficiently accurately. Each cap 11 can be a modified golf tee with a vertical hole drilled through its bottom end to receive a stud 3. Preferably, the caps are made of a resilient rubber-like elastomer material, so that if a putted golf ball touches a cap 11, the ball tends to be abruptly slowed down.

A plastic semicylindrical removable ball stop 5 adjacent simulated putting cup 4 can be placed on the left pair of pegs 3, to serve as target for the golfer.

As best seen in FIGS. 2 and 3, planar base 2 includes a thin, steel planar plate 8 having a layer of thin, preferably green, indoor/outdoor type carpet 7 uniformly attached to its upper surface. A pair of plastic edge covers 6, preferably white, are attached to the opposite side edges of the practice putting device 1.

Each of the studs 3 is firmly affixed in the steel base 8, as shown, and extends upward through holes in the carpet 7.

Figure 4A:
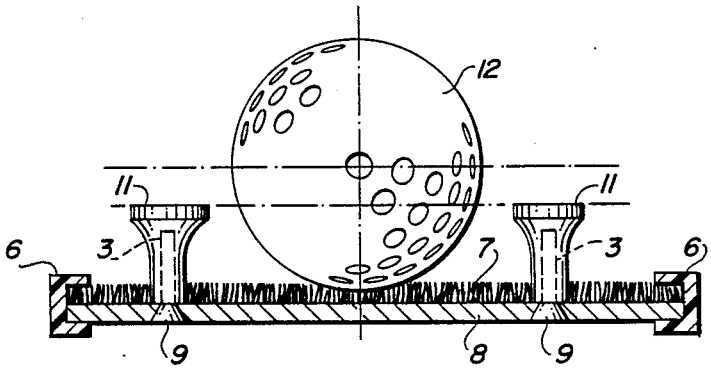
FIG. 4A is a partial section view illustrating use of short caps to define a putting path requiring a relatively low degree of putting accuracy.
Figure 4B:
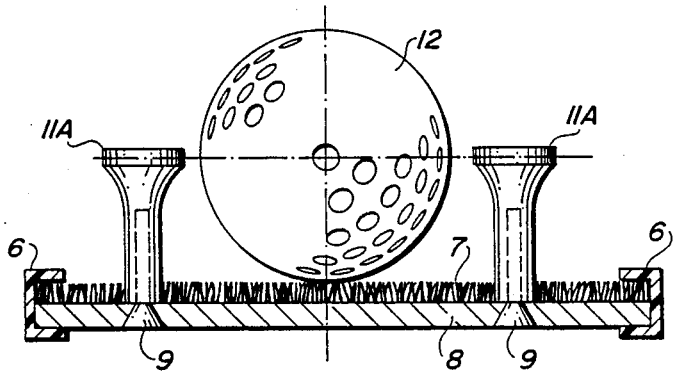
FIG. 4B is a partial section view illustrating use of different caps to define a narrower putting path requiring a greater degree of putting accuracy.

As best shown in FIGS. 4A and 4*b*, the height of caps 11 in FIG. 4A is shorter than the radius of the golf ball 12, and provides a particular total gap width to the surfaces of a golf ball centered over axis 10. In FIG. 4B, the modified golf tees 11A have a height equal to the radius of the golf ball, providing a narrower total gap width to the surfaces of the centered golf ball 12, and requiring more putting accuracy if the ball is to traverse the distance along the putting path from putting end 2A to target end 2B.

In the presently preferred embodiment of the invention, the steel plate 8 is one-sixteenth of an inch thick, 6 inches wide, and 60 inches long. The center-to-center spacing between the studs of rows 3A and 3B is 2.5 inches. The left pair of studs 3 on which the ball stop 5 can be mounted are located one inch from the left end of the practice putting device. The second pair of studs 3 is located 8 inches to the right of the first pair. The additional five pairs of studs 3 each are spaced along 4 inch centers from left to right. Carpet 7 is preferably three-sixteenths of an inch thick, and can be a tight loop type such as PIER 1, Style P1201, color code 1201-sea moss, manufactured by Sheridan Mills. Each of the studs 3 can be 0.160 inches in diameter and extend one-half inch above the upper surface of carpet 7.

The combined thickness of the carpet 7 and the steel plate 8 is only one-fourth of an inch. Thus, the position of the golf ball is not raised enough to adversely affect the golfer's putting accuracy, contrary to many of the prior known putt practice devices which support the golf ball to be putted at a substantially higher elevation above the surface on which the golfer is standing as he putts. The caps of the prototype constructed are approximately one-half inch. Presently, the total gap, equal to the sums of the gaps between the ball and the caps on either side of the ball, is thought to be most satisfactory if in the range from about seven-eighths of an inch to eleven-sixteenths of an inch.

Referring next to FIG. 5A, utilization of the putt practice device 1 on an ordinary putting green is illustrated. The ball stop 5 has been removed. Line 15 indicates the path of an accurately putted golf ball 12 as it moves between the rows 3A and 3B. Line 18 indicates the linear path of the golf ball after it rolls off the end of the thin planar base 2 along a perfectly horizontal putting green to a hole 17 marked by a flag 16. FIG. 5B shows use of the putt practice device on a putting green in which the putting path is sloped. The putt practice device 1 is aimed to the left of hole 15 in this case because the putting green surface is sloped so as to cause the golf ball to curve along the path 18A as it rolls toward the hole 17.

During putting, the white plastic edge strips 6 allow the golfer to easily see whether his or her putting stroke is precisely parallel to center axis 10, as is desired, and to see the extent of any deviation from parallel.

It has been found that the practice putting device 1 is very effective in helping a golfer improve both his aim of the ball toward a distant hole and the accuracy of his putting. Utilization of the putt practice device 1 also helps the golfer improve his judgement as to where to aim a golf ball to compensate for slope in the putting green surface.

FIG. 6A illustrates the fact that the planar base 2 is flexible. The target end of putt practice device 1 is elevated by means of an end member 20, in order to simulate a longer putt and/or to cause the golf ball to automatically return to the user. FIG. 6B illustrates a possible construction of the end plate, in which an opening 21 is defined by end slots 22 into which the target end of the base plate 2 snugly fit.

The above-described putt practice device is relatively light, and is very versatile in its utilization. It can be readily used in the user's home, office, or on a putting green, and can be carried easily in the trunk of most automobiles. The width of the gap between the caps of rows 3A and 3B defining the putting path can be adjusted by using different heighth modified golf tees to provide any degree of difficulty or putting accuracy required.

While the invention has been described with reference to a particular embodiment thereof, those skilled in the art will be able to make the various modifications to the described embodiment of the invention without departing from the true spirit and scope thereof. For example, the structure of the caps 11 could be different from what is shown. For example, adjustable caps could be provided with eccentric holes, so the caps could be turned on studs 3 to define the putting accuracy needed for the ball to reach the target end 2B. The studs and/or caps 3 could be mounted on moveable brackets.

What is claimed is:

1. A putt practice device comprising in combination:
(a) an elongated, narrow, planar base having an upper putting surface, a putting end, and a target end, and a longitudinal center axis;
(b) a first row of rigid vertical studs extending upward from the upper surface, the first row of studs being parallel to the center axis, and a second row of rigid vertical studs extending upward from the upper surface, the first and second rows being parallel to and symmetrically disposed about the center axis;
(c) a plurality of removable caps mounted on the studs, respectively, each cap having a bottom hole receiving a stud, respectively, the caps defining a putting path along the upper surface.

2. The practice putting device of claim 1 including a removable ball stop disposed on a stud of the first row nearest to the target end and on a stud of the second row nearest to the target end.

3. The putt practice device of claim 2 wherein the planar base includes a thin, flexible steel plate.

4. The putt practice device of claim 3 including a thin layer of carpet material adhesively attached generally coextensive with an upper surface of the steel plate.

5. The putt practice device of claim 4 wherein the caps are resilient plastic caps which determine gaps between the caps of the first and second rows and a putted golf ball rolling along the putting path a total length of a pair of gaps between opposite sides of a golf ball in the putting path and the caps is in the range from seven-eighths of an inch to eleven-sixteenths of an inch.

6. The practice putting device of claim 5 wherein the steel plate is approximately one-sixteenth of an inch thick, approximately 60 inches long, and approximately 6 inches wide.

7. The practice putting device of claim 2 wherein the moveable ball stop includes a plastic semicylindrical element having a vertical concave face oriented toward the putting end.

8. The practice putting device of claim 7 including a pair of plastic side strips attached to opposite sides of the planar base.

9. A putt practice device comprising in combination:
(a) an elongated, narrow, flexible, planar base having an upper putting surface, a putting end, and a target end, and a longitudinal center axis, the base including a thin, flexible steel plate and a thin layer of carpet material uniformly disposed on the steel plate, the combined thickness of the steel plate and the layer of carpet being approximately one-fourth of an inch;

(b) first and second rows of means attached to said base and extending upward from the upper surface and positioned parallel to and symmetrically disposed about the center axis for defining a putting path along the upper surface.

10. The putt practice device of claim 9 wherein a total length of a pair of gaps between opposite surfaces of a golf ball in the putting path and the putting path defining means is in the range from approximately eleven-sixteenths of an inch to three-quarters of an inch.

* * * * *